US012134122B2

(12) United States Patent
Haanappel et al.

(10) Patent No.: US 12,134,122 B2
(45) Date of Patent: Nov. 5, 2024

(54) INORGANIC BINDER SYSTEM

(71) Applicant: FOSECO INTERNATIONAL LIMITED, Barlborough Links (GB)

(72) Inventors: Vincent Haanappel, Hengelo (NL); Thomas Linke, Wedemark (DE)

(73) Assignee: FOSECO INTERNATIONAL LIMITED, Derbyshire (GB)

( * ) Notice: Subject to any disclaimer, the term of this patent is extended or adjusted under 35 U.S.C. 154(b) by 0 days.

(21) Appl. No.: 18/577,215

(22) PCT Filed: Jul. 12, 2022

(86) PCT No.: PCT/EP2022/069506
§ 371 (c)(1),
(2) Date: Jan. 5, 2024

(87) PCT Pub. No.: WO2023/285482
PCT Pub. Date: Jan. 19, 2023

(65) Prior Publication Data

US 2024/0253107 A1 Aug. 1, 2024

(30) Foreign Application Priority Data

Jul. 12, 2021 (EP) ..... 21184981

(51) Int. Cl.
*B22C 1/18* (2006.01)
*B22D 19/00* (2006.01)

(52) U.S. Cl.
CPC ..... *B22C 1/188* (2013.01); *B22C 1/181* (2013.01); *B22D 19/00* (2013.01)

(58) Field of Classification Search
CPC ..... B22C 1/188; B22C 1/181; B22C 1/02; B22C 1/18; B22D 19/00
See application file for complete search history.

(56) References Cited

U.S. PATENT DOCUMENTS

| | | | |
|---|---|---|---|
| 4,316,744 | A | 2/1982 | Bergna |
| 4,505,750 | A | 3/1985 | Cowan |
| 7,770,629 | B2 | 8/2010 | Weicker |
| 2015/0306658 | A1 | 10/2015 | Deters |

FOREIGN PATENT DOCUMENTS

| | | | |
|---|---|---|---|
| CN | 111889616 | A | 11/2020 |
| EP | 2359957 | A1 | 8/2011 |

OTHER PUBLICATIONS

International Search Report and Written Opinion received for PCT Serial No. PCT/EP2022/069506 on Oct. 4, 2022, 10 pgs.
International Preliminary Report on Patentability received for PCT Serial No. PCT/EP2022/069506 on Aug. 25, 2023, 16 pgs.
Extended European Search Report received for EP Application No. EP21184981 on Nov. 29, 2021, 9 pgs.

*Primary Examiner* — Kevin P Kerns
*Assistant Examiner* — Steven S Ha
(74) *Attorney, Agent, or Firm* — Merchant & Gould P.C.

(57) ABSTRACT

A composition for making cores and a process for metal casting, the composition comprising: a particulate refractory material; an inorganic binder comprising at least one alkali metal silicate; a pozzolanic additive; and a lustrous carbon former. The process includes forming a core from the composition and assembling a mould comprising the core and supplying molten metal.

10 Claims, 6 Drawing Sheets

INORGANIC BINDER SYSTEM

CROSS-REFERENCE TO RELATED APPLICATION

The present application is a National Stage Application of PCT International Application No.: PCT/EP2022/069506 filed on Jul. 12, 2022, which claims priority to European Patent Application 21184981.5, filed with the European Patent Office on Jul. 12, 2021, the disclosure of which is incorporated herein by reference in its entirety.

TECHNICAL FIELD

The present invention relates to a composition for use as a core in a casting or moulding process, a core comprising the composition, casting moulds comprising a core, and a method for producing an article using a core.

BACKGROUND

In a gravity casting process, molten metal (or metal alloy) is poured into a pre-formed mould cavity which defines the external shape of the casting, with the molten metal filling the mould cavity under the force of gravity. The shape of hollow sections or internal cavities in the casting may be defined by a disposable core. The cores may be bound with organic resins, binders in powder form, clay minerals or water glass, the latter often referred to as liquid inorganic binder. Nowadays binding of sand cores and moulds with organic binders for example with organic resins in general is not the preferred method since the decomposition products of organic binders are often toxic and the compositions release toxic fumes upon curing or during casting which introduce risks for the foundry workers and have other negative environmental impacts, and can be expensive to mitigate. A further problem with many existing core binder systems is the quality of the finished surface of the cast component. The long casting times and harsh conditions involved frequently leads to surface on the casting such as sand adhesion, as well as the breaking of, and metal ingress into, the cores themselves.

U.S. Pat. No. 4,316,744 discloses high ratios of silicate foundry sand binders comprising an aqueous solution of sodium, potassium or lithium silicate and containing amorphous silica. The core and mould compositions as disclosed in U.S. Pat. No. 4,316,744 are cold setting and are set with carbon dioxide or a suitable acid releasing curing agent. The disadvantage of such moulding compositions and particularly the method of setting binder systems with carbon dioxide is that purging of the moulded composition with carbon dioxide results in a strength which is always lower than in case of the use of the technology comprising hot curing with a heated metal core box and heated air to purge the sand cores. It is thus an object of the present invention to provide a foundry moulding composition which is particularly suitable for moulding of high strength cores in a so-called heated core box in which the moulded material simply can be cured by purging with heated air.

US2015/306658 describes mould mixtures containing at least one aluminium oxide and a water glass based binder. U.S. Pat. No. 7,770,629 describes moulding mixtures for producing casting moulds for metalworking, wherein the moulding mixtures comprise a binder based on water glass. CN111889616 describes a curing agent for casting, which comprises inter alia a metal alkali.

It is thus an object of the present invention to mitigate or ameliorate the above problems.

SUMMARY OF INVENTION

Composition

According to a first aspect of the invention, there is provided a composition for making a core for use in a metal casting process. The composition may comprise a particulate refractory material. The composition may comprise an inorganic binder. The inorganic binder may comprise at least one alkali metal silicate. The composition may comprise a pozzolanic additive. The composition may comprise a lustrous carbon former.

As used herein, the term 'lustrous carbon former' refers to foundry additives which form lustrous carbon under the effect of casting conditions. The additives typically comprise organic compounds which volatilise under the conditions at the mould-metal interface thereby forming lustrous carbon.

The inventors have found that cores made from the composition of the first aspect have sufficient strength to withstand the forces experienced during the casting process, have excellent de-coring properties and avoid or minimise the number of surface defects of the metal casting. In a further advantage, the composition of the first aspect can be used without requiring a coating applied to the core prior to use in a moulding or casting process.

Lustrous Carbon Former

In a series of embodiments, the lustrous carbon former may be a strong lustrous carbon former. The composition may be for making a core for use in a ferrous metal casting process. In an alternative embodiment, the composition may be for making a core in a high temperature non-ferrous metal casting process, such as copper casting and alloys thereof. In the present context, high temperature means above approximately 1000° C.

The strong lustrous carbon former may comprise one or more of: asphalt; hydrocarbon resin; polystyrene; and gilsonite. The strong lustrous carbon former may have a lustrous carbon content of at least 15%. In some embodiments, the strong lustrous carbon former may have a lustrous carbon content of at least 16%, 17%, 18%, 19%, 20%, 22%, 24%, 25%, 26%, 28%, or 30%.

The strong lustrous carbon former may comprise 0.1 to 1.5 wt % relative to the weight of the particulate refractory material. In some embodiments, the strong lustrous carbon former may comprise 0.2 to 1.4 wt %, 0.3 to 1.3 wt %, 0.4 to 1.2 wt %, 0.5 to 1.1 wt %, 0.6 to 1.0 wt %, 0.7 to 0.9 wt %, 0.8 wt %, or a range formed from combinations thereof.

The inventors have found that for ferrous casting it is advantageous when the lustrous carbon former comprises between 10 to 80 wt % of a carbon-containing resin such as gilsonite (based on total weight of lustrous carbon former). The presence of this resin between 0.05 to 0.5 wt. %, 0.1 to 0.4 wt. %, 0.2 to 0.4 wt % based on the weight of the particulate refractory material has been found to achieve high-quality casting surfaces. Particularly it has been found that the presence of this lustrous carbon former in the composition significantly enhances the de-coring properties after the casting process. It was surprisingly found that the sand cores could be used uncoated for casting in GJS and GJV (iron casting). A defect-free casting surface was achieved.

The present inventors have also found that for copper and copper alloy castings the presence of gilsonite has been found advantageous, resulting in cores with excellent cold strength and excellent de-coring properties, especially in the absence of a coating on the cores prior to casting.

In a further series of embodiments, the lustrous carbon former may be a weak lustrous carbon former. The composition may be for making a core for use in a non-ferrous metal casting process. E.g. the composition may be for making a core in a low temperature non-ferrous metal casting process. In context, low temperature means below 1000° ° C., or optionally, below 900° C. or below 800° C.

The weak lustrous carbon former may comprise one or more of: graded coal, coal dust, and seacoal. The weak lustrous carbon former may have a lustrous carbon content of less than 15%. In some embodiments, the weak lustrous carbon former may have a lustrous carbon content of less than 14%, less than 13%, less than 12%, less than 11%, less than 10%, less than 9%, or less than 8%.

The weak lustrous carbon former may comprise 0.1 to 1.5 wt % relative to the weight of the particulate refractory material. In some embodiments, the weak lustrous carbon former may comprise 0.2 to 1.4 wt %, 0.3 to 1.3 wt %, 0.4 to 1.2 wt %, 0.5 to 1.1 wt %, 0.6 to 1.0 wt %, 0.7 to 0.9 wt %, 0.8 wt %, or a range formed from combinations thereof.

A composition particularly suited for aluminium casting may comprise from 5 to 40 wt. % of graded coal, and preferably from 5 to 30 wt. %, or 5 to 20 wt. %. Said graded coal may have a median particle size D50 of between 20 μm 500 μm, 40 μm and 200 μm, or 50 μm and 100 μm. Surprisingly, already small amounts of graded coal in the composition result in an improved casting surface quality when compared to composition without graded coal. The type of graded coal which is particularly suitable for the composition according to the invention is characterised by 30% up to 45% of volatiles, 20% up to 30% moisture, and 8 to 12% lustrous carbon.

The inventors of the current invention surprisingly found that the presence of a lustrous carbon former, particularly of coal dust and/or naturally carbon-containing resin in a small amount allows the production of cores which guarantee a smooth and sand free casting surface, particularly when casting non-ferrous materials e.g. aluminium. The inventors found out that the use of the small amount of graded coal with a low concentration of lustrous carbon will give very smooth and sand free casting surface particularly for aluminium castings.

A composition where the lustrous carbon former is selected from a group comprising one or more of graded coal, activated carbon, carbon black and naturally occurring carbon-containing resin such as gilsonite will give particular good results for producing cores.

In a further series of embodiments, two or more different lustrous carbon formers may be used. For example, the composition may comprise a blend of a strong and a weak lustrous carbon former. The blend of strong and weak lustrous carbon former may be in any ratio e.g. 10:90, 20:80, 30:70, 40:60, 50:50, 60:40, 70:30, 80:20, 90:10, or any point therebetween. The blend may be configured to obtain a desired lustrous carbon content in the overall composition.

Particulate Refractory Material

The particulate refractory material may comprise a natural refractory material, a synthetic refractory material or a combination thereof. The particulate refractory material may comprise sand. The sand may be selected from a group comprising quartz sand, zirconium silicate sand, chromite sand, bauxite sand, olivine sand or beads of ceramics.

The sand may be any type of sand suitable for use in refractory applications, such as quartz sand. In some embodiments, the particulate refractory material may comprise any one or more conventional refractory materials, such as oxides, carbides, nitrides etc of silicon, aluminium, magnesium, calcium and zirconium and other elements. Suitable refractory materials include but are not limited to quartz, olivine, chromite, zircon, and alumina. In some embodiments, the particulate refractory material comprises spherical particles and/or cenospheres, such as fly ash. In some embodiments, the particulate refractory material comprises a mixture of sand and spherical particles and/or cenospheres, such as a mixture of sand and fly ash.

The particulate refractory material may comprise fresh particulate refractory material as well as reclaimed material.

In some embodiments, the particulate refractory material has a D50 particle diameter of at least 20 μm, at least 50 μm, at least 100 μm, at least 250 μm, or at least 500 μm. In some embodiments, the particulate refractory material has a D50 particle diameter of no more than 2 mm, no more than 1 mm or no more than 500 μm. In some embodiments, the particulate refractory material has a D50 particle diameter of from 20 μm to 2 mm, from 50 μm to 2 mm or from 50 μm to 1 mm. The D50 value means that 50% of the particles have a size below and up to a certain diameter when analysed by sieving which is for the sand preferably done with a sieving apparatus according to DIN EN 933.

Inorganic Binder

The inorganic binder may comprise one or more of sodium silicate, potassium silicate, lithium silicate or a combination thereof. The inorganic binder may comprise 0.5 wt % to 5 wt % relative to the weight of the particulate refractory material. The inorganic binder may comprise 1 to 4.5 wt %, 1.5 to 4 wt %, 2 to 3.5 wt %, or 3 wt % relative to the weight of the particulate refractory material, or a range formed from combinations thereof.

In some embodiments the at least one alkali metal silicate comprises sodium silicate. In some embodiments, the at least one alkali metal silicate comprises potassium silicate. In one series of embodiments, the at least one alkali metal silicate comprises sodium silicate and potassium silicate.

The alkali metal silicate may be in aqueous solution. The aqueous solution may have a solids content of between 30 and 50 wt %. In some embodiments, the solids content may from 32 to 48 wt %, from 34 to 46 wt %, from 35 to 45 wt %, from 36 to 44 wt % or from 38 to 42%. The solids content may be approximately 40 wt %.

The inorganic binder may be a heat-setting binder. The inorganic binder may be cured at temperatures from 50 to 250° C. e.g. in a heated metal core box.

A commercially available binder comprises a mixture of a lithium and sodium silicate with a weight ratio 2.1 and a solid content between 40% and 45%, viscosity mPa·s (20° C.) 256 and a density between 1.45 and 1.55 g/cm$^3$ (20° C.). Another commercially available water glass is for example a pure sodium silicate with the following specification: solid content between 41% and 47%, a weight ratio between 2.2 and 2.4, and a density between 1.45 and 1.55 g/cm$^3$ (20° C.).

Pozzolanic Additives

The pozzolanic additive may comprise 0.1 wt % to 2 wt % relative to the weight of the particulate refractory material. The pozzolanic additive may comprise 0.2 to 1.9 wt %, 0.3 to 1.8 wt %, 0.4 to 1.7 wt %, 0.5 to 1.6 wt %, 0.6 to 1.5 wt %, 0.7 to 1.4 wt %, 0.8 to 1.3 wt %, 0.9 to 1.2 wt %, 1.0 to 1.1 wt % relative to the weight of the particulate refractory material, or a range formed from combinations thereof.

The pozzolanic additive may comprise silica fume and/or fused silica and/or pyrogenic silica and/or micro-silica. Silica fume is a very fine amorphous silica also referred to as condensed silica fume, micro-silica, or silica dust. In some embodiments, the pozzolanic additive comprises 20-90 wt % of silica fume.

The bulk density of commercially available silica fume as used herein may range between not densified of about 120 $kg/m^3$ to densified or compacted up to about 800 $kg/m^3$, and with a specific gravity of 2.1 to 2.4 and a surface area (BET) from 5 to 30 $m^2/g$. The silica fume may have a D90 particle size from 0.1 μm up to 1 μm. The D90 value means that 90% of the particles have a size below and up to a certain particle size. The silica fume has a typical average particle size preferably of 0.10 to 1.0 μm, more preferable between 0.10 and 0.5 μm, and most preferable between 0.10 and 0.30 μm, however particle size analysis often shows the presence of a large number of agglomerated particles having average sizes between 10 and 100 μm. Some agglomerates are difficult to break due to strong bonds being produced during silicon smelting, hence the results of conventional size measurements are often significantly different from the true particle size distribution. Modern laser particle size analysers with built-in ultrasound, used with special dispersants have been used to accurately measure the particle sizes quoted above.

A suitable fused silica comprised by the additive of the composition according to the invention could be preferably a fused silica with an average particle size between 10 and 90 μm, more preferably between 20 and 70 μm, and even more preferred between 30 and 50 μm. The composition may comprise small amounts of pyrogenic silica, preferably with a D50 particle size from 0.1-20 μm, more preferably between 0.1 and 15 μm, most preferably between 0.15 and 12 μm.

In a series of embodiments, the composition further comprises a pozzolanic filler selected from a group of one or more aluminium silicate, sintered mullite, silicon dioxide, organo-modified silicon dioxide and fly ash. All the aforementioned substances are highly reactive pozzolans. For example, aluminium silicate beads with a preferred average particle size between 10-120 μm, more preferably between 20 and 100 μm, and most preferably between 25 and 80 μm is particularly suitable. Another commercially available product is a sintered ceramic solid which comprises up to 75% of mullite. Mullite is a silicate mineral. Yet another filler is a substance available as an organo-modified silicon dioxide; the surface of which has been modified with an epoxy silane.

Surfactants

The inorganic binder may comprise a surface-active agent, preferably an anionic surfactant. In some embodiments, the surfactant is sodium ethyl hexyl sulphate. In some embodiments, other types of surfactants e.g. cationic, non-ionic, or amphoteric surfactants may be comprised in the inorganic binder as used herein. The surface-active agent reduces the surface tension of the liquid binder and thus improves flowability of the composition. Flowability of the composition is an important aspect which contributes to the shaping accuracy of moulds and/or cores. While generally the composition is well suitable for preparing foundry moulds and cores the composition is particularly suited to produce foundry cores.

Particularly suitable as a surfactant is for example an an-ionic surfactant with a fraction of this type in the liquid phase preferable between 0.05 and 2.0 wt. %, more preferably between 0.10 and 1.0 wt. %, most preferable between 0.20 and 0.6 wt. %.

Other

Preferably, the composition comprises from 0 to 0.5 wt. % of clays/clay minerals based on the weight of the sand, more preferably between 0 and 0.4 wt. %, most preferably between 0 and 0.3 wt. %. That is to say, the composition might only comprise impurities of clay and is otherwise free of any clay minerals.

The composition may comprise a water repellent e.g. a silicon organic water repellent. The water repellent may improve the resistance of the composition against humidity and improve the mechanical strength of the cores produced from composition.

Cores

According to a second aspect of the invention, there is provided a core for use in a moulding or metal casting process comprising the composition of the first aspect of the invention.

Process

According to a third aspect of the invention, there is provided a process for producing a metal article by metal casting. The process may comprise mixing a composition as described previously to form a mixture. The process may comprise moulding and hardening the mixture to produce a core in the shape of an internal cavity of the article. The process may comprise assembling the core with a mould for metal casting, such that the mould and the core together define a casting cavity. The process may comprise supplying molten metal into the mould cavity until the mould cavity is filled. The process may comprise cooling and solidifying the molten metal to form the article.

The process may comprise mixing a composition as described previously and which comprises a strong lustrous carbon former. The process may comprise supplying molten metal at a temperature of at least 1000° C. into the mould cavity until the mould cavity is filled. In some embodiments, the metal may be supplied at a temperature of at least 1050° C., 1100° C., 1150° C., 1200° C., 1250° C., 1300° C., 1350° C., 1400° C., 1450° C., or 1500° C. In a first series of embodiments, the process may be for producing a ferrous metal article by ferrous metal casting. For example, the process may be for producing articles from iron, including grey iron, compacted graphite iron, ductile iron, from steel and from alloys thereof. In a further series of embodiments, the process may be for producing a non-ferrous metal article by non-ferrous metal casting. For example, the process may be for producing articles from copper and copper alloys, including brasses and bronzes.

In a further series of embodiments, the process may comprise a mixing a composition as described previously and which comprises a weak lustrous carbon former. The process may be for producing a non-ferrous metal article by non-ferrous metal casting. The process may comprise supplying metal at a temperature of less than 1200° C. For example, the process may be for producing articles from copper and copper alloys, including brasses and bronzes. In a further series of embodiments, the process may comprise supplying metal at a temperature of less than 800° C. The process may be for producing a non-ferrous metal article, such as from aluminium, zinc, tin, or other non-ferrous metals and alloys thereof.

The step of moulding and hardening the mixture may include drying the mixture. The step of moulding and hardening the mixture may include compacting the mixture into a core mould. The step of moulding and hardening the mixture may be performed using a core-shooting apparatus. The step of moulding and hardening the mixture to produce a core includes producing the core by an additive manufacturing or 3D printing process.

The method may comprise introducing the composition into a mould and heat curing the composition at a temperature from 50° C. up to 250° C. preferably for a time from 30 seconds up to 5 minutes. Heat curing may be conducted by purging the foundry mould composition with hot air. The heated core box technology, also herein referred to as hot box technology or heated metal core box, is particularly advantageous for preparing foundry cores with the composition. Depending on the requirements and applications of the cores, core strength values can be easily adapted. Bending strength values between 200 and 1500 N/cm$^2$ obtainable with the heated core box technology. This heated core box process normally involves producing cores from sand, synthetic minerals and powder additives and a liquid binder in a core shooting machine and hardening the cores in a heated metal core box. This process enables the production of cores of high or very high complexity since flowability of the composition and thus shaping accuracy are very high. This allows the production of cores with a relatively high edge sharpness. Advantages of this process are that the cores are easily releasable from the mould and have a high dimensional accuracy, fine surfaces, defined edges, and the cores decompose easily after the casting process. The process may involve producing cores from the composition in a core shooting machine and hardening the cores in a heated metal core box by purging with hot air.

The process may further comprise removing the article containing the core from the mould. The method may comprise removing the core from the internal cavity e.g. by shaking, flushing out with water, sand or shot blasting etc.

EXAMPLES

Experiment 1—Initial Compositions for Ferrous Casting

A series of cores were produced from quartz sand type H33 mixed with the binders and additives in Table 1 below. Mixing was performed with Hobart mixer for 1 minute and then repeated for a second minute.

Figure 1:
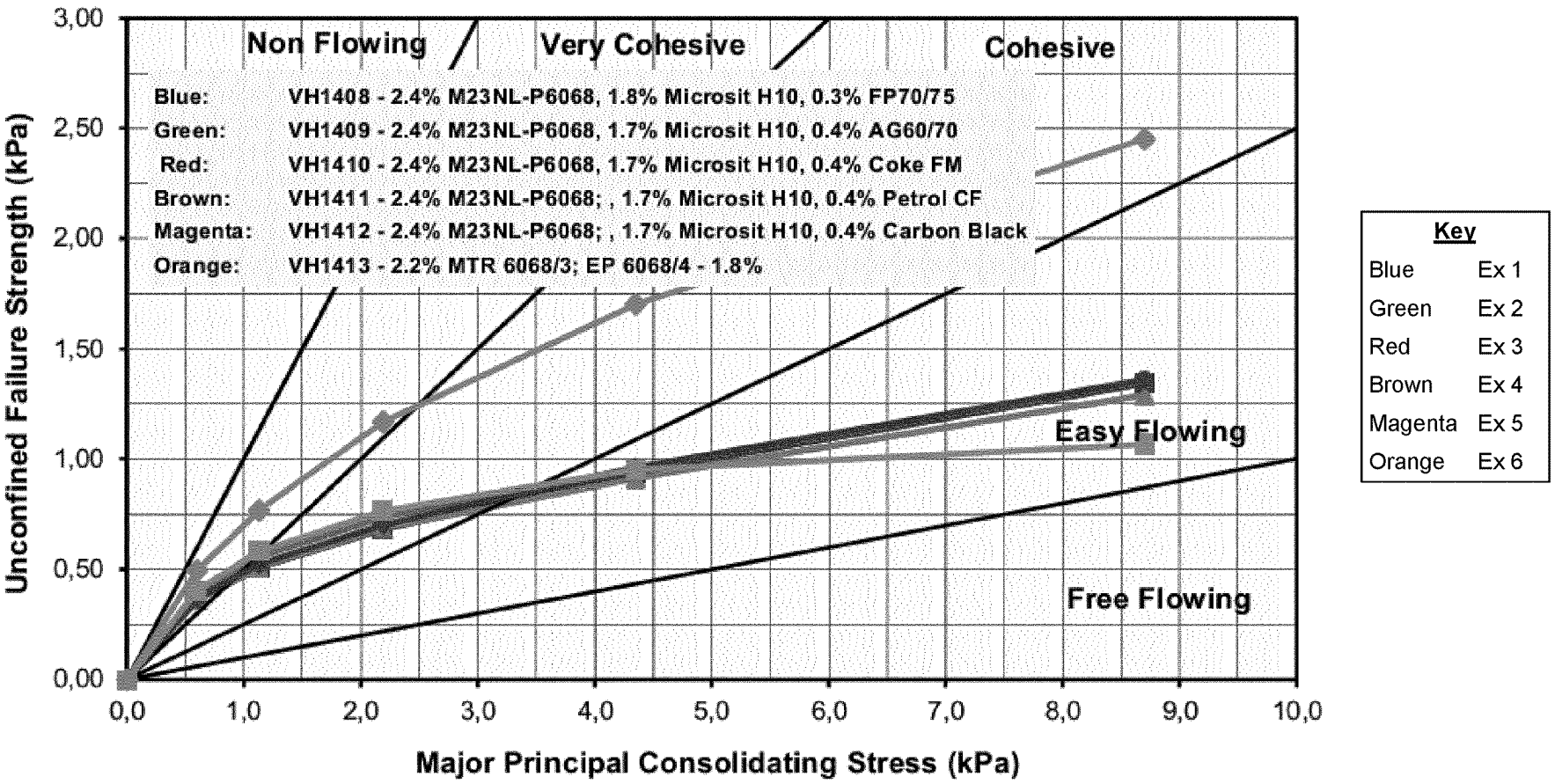
FIG. 1 is a graph of the flowability characteristics of the compositions of Table 1.

A Brookfield Powder Flow Tester was used to test the flowability characteristics of the compositions and measure flow function of the compositions. In turn, a sample of each of the compositions was loaded into a cell in the Brookfield PFT and a vertical force was then applied to the powder to compact it (the Major Principal Consolidating Stress). Subsequently, a rotational force is applied to the compacted powder while the same Major Principal Consolidation Stress is maintained in order to determine the force required to initiate flow of the powder (the Unconfined Failure Strength). The process is repeated at a range of consolidation stresses and the flow function constructed by plotting the unconfined failure strength against the consolidation stress as shown in FIG. 1 and thus determine the internal resistance to flow of the composition. Typically, greater flowability is desirable to reduce problems with powder handling and transport, and to avoid moulding defects. No obvious difference was observed between Ex. 1 to 4 and 6, with only Ex. 5 showing significantly lower flowability due to the inclusion of carbon black within the composition.

Transverse bars were manufactured with the Laempe laboratory machine type L1 being developed for manufacturing test-cores in heated and non-heated tooling, using gas hardening processes like $CO_2$, cold box and hot box. The sand mixture is automatically injected in the core box, which is clamped between the side presses, and can be heated at various temperatures. The release of high pressured air blows the sand from the sand storage bunker into the core box at high speed. The total elapsed shooting time was set at 1 s and with a shooting pressure of 4 bar (400 kPa). All specimens were purged with heated air for 120 s at 120° C. Core box temperature was set at 140° ° C.

Figure 2:
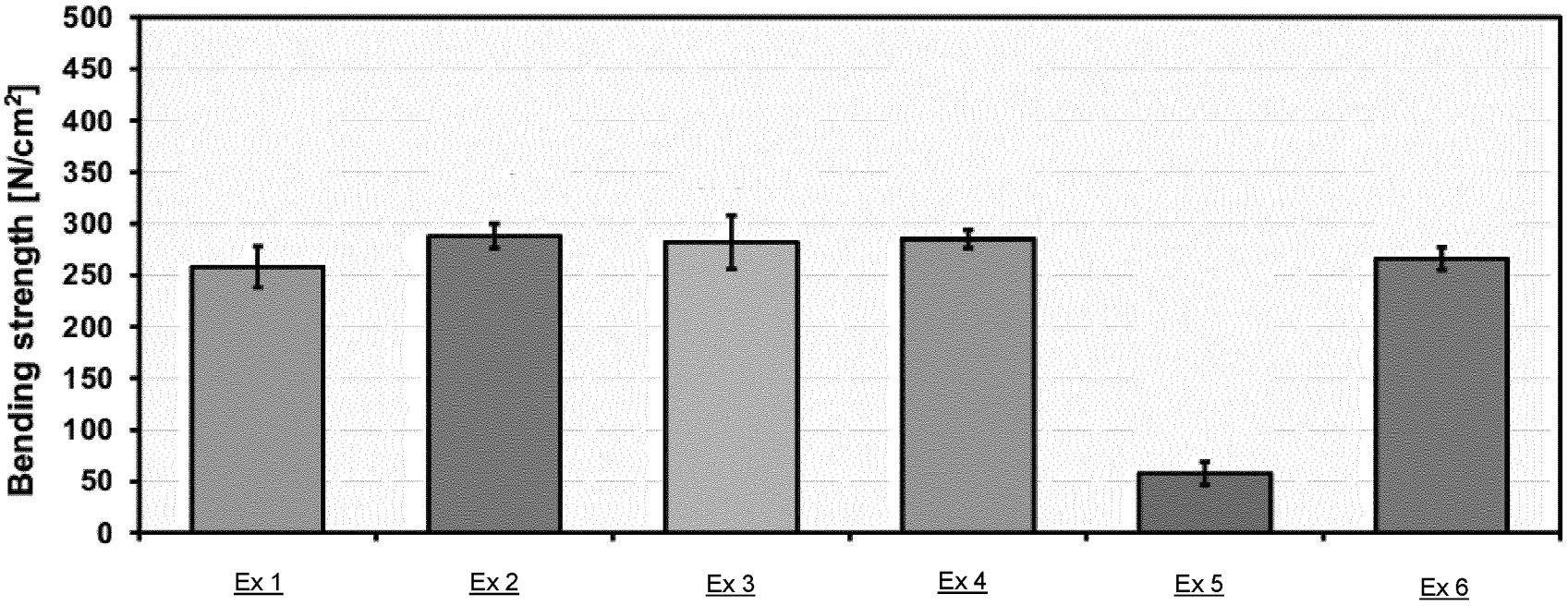
FIG. 2 is a graph of the bending strengths of cores formed from the compositions of Table 1.

Bending strength of the samples was measured with a Tinius Olsen H5K-T strength tester, computer controlled with Q-mat software for 3-point bending tests and the results graphed in FIG. 2. The lowest strength was obtained with carbon black as the breakdown agent and was between 50 and 60 N/cm$^2$—these cores were highly friable.

TABLE 1

| Composition | Ex1 | Ex2 | Ex3 | Ex4 | Ex 5 | Ex6 |
|---|---|---|---|---|---|---|
| **Binder** [a, b] | **2.4%** | **2.4%** | **2.4%** | **2.4%** | **2.4%** | **2.2%** |
| M23NL [1] | 94.5 | 94.5 | 94.5 | 94.5 | 94.5 | 77.5 |
| Water | 5.0 | 5.0 | 5.0 | 5.0 | 5.0 | 22.0 |
| DSK40 [2] | 0.5 | 0.5 | 0.5 | 0.5 | 0.5 | 0.5 |
| **Total additive** [a, c] | **2.1%** | **2.1%** | **2.1%** | **2.1%** | **2.1%** | **1.8%** |
| Microsit H10 [3] | 85 | 80 | 80 | 80 | 80 | — |
| FP70/75 [4] | 15 | — | — | — | — | — |
| AG60/70 [5] | — | 20 | — | — | — | — |
| Coke FM [6] | — | — | 20 | — | — | — |
| Petrol Coke Flower [7] | — | — | — | 20 | — | — |
| Carbon Black [8] | — | — | — | — | 20 | — |
| Silica Fume A [9] | — | — | — | — | — | 22 |
| EFA-Füller [10] | — | — | — | — | — | 74 |
| **Collapsibility** | Easy | Easy | Easy | Moderate/easy | Very easy | Moderate/easy |

[a] values in bold are in wt % relative to weight of particulate;
[b] values for individual compounds listed below are in wt % relative to weight of total binder;
[c] values for individual compounds listed below are in wt % relative to weight of total additive
[1] Sodium silicate M23NL (BASF, Monheim, Germany)
[2] DSK 40 (2-ethylhexyl sulphate sodium), 0.5% (Anionic surfactant, Brenntag, Enschede, the Netherlands)
[3] H10—Microsit H10 fly ash (BauMineral GmbH, Herten, Germany)
[4] Graphite FP70/75 (IMCD Benelux BV, Rotterdam, Netherlands)
[5] Amorphous Graphite (Grafitbergbau Kaiserberg, St Stefan ob Loben, Austria)
[6] Coke Flour M (Müco Mücher & Enstipp GmbH, Essen, Germany)
[7] Petrol Coke Flour (Müco Mücher & Enstipp GmbH, Essen, Germany)
[8] Carbon Black (IMCD Benelux BV, Rotterdam, Netherlands)
[9] Silica Fume A (COFERMIN Chemicals GmbH & Co., Essen, Germany)
[10] EFA Fuller HP, fly ash (Krahn Chemie, Zaandam, Netherlands)

The above cores were tested in a casting trial using ductile iron with a pouring temperature of 1355° C. After the casting process, core residue was removed and qualitatively measured and the results listed in Table 1 above. De-coring after the casting trials was easiest for the cores containing carbon black. Slightly less collapsibility was found with Ex 4 and Ex 6. The inner surface of the castings were investigated. It was clear that in all cases, no significant difference occurred between the various inner surfaces and in all cases the surface was relatively rough with sand grains adhering to the surface.

Experiment 2—Further Ferrous Investigations

Ex. 6 above was selected for further development and improvement. Sand mixtures based on quartz sand type H33 were mixed with the binders and additives in Table 2 below. The gilsonite would be considered an additive within the context of the present invention, but the gilsonite content is listed separately in Table 2 for ease of comparison and to simplify the test procedure. The total additive content can be calculated by adding the additive concentration and gilsonite concentration, since both are record in wt % relative to the weight of the particulate refractory material.

Figure 3:
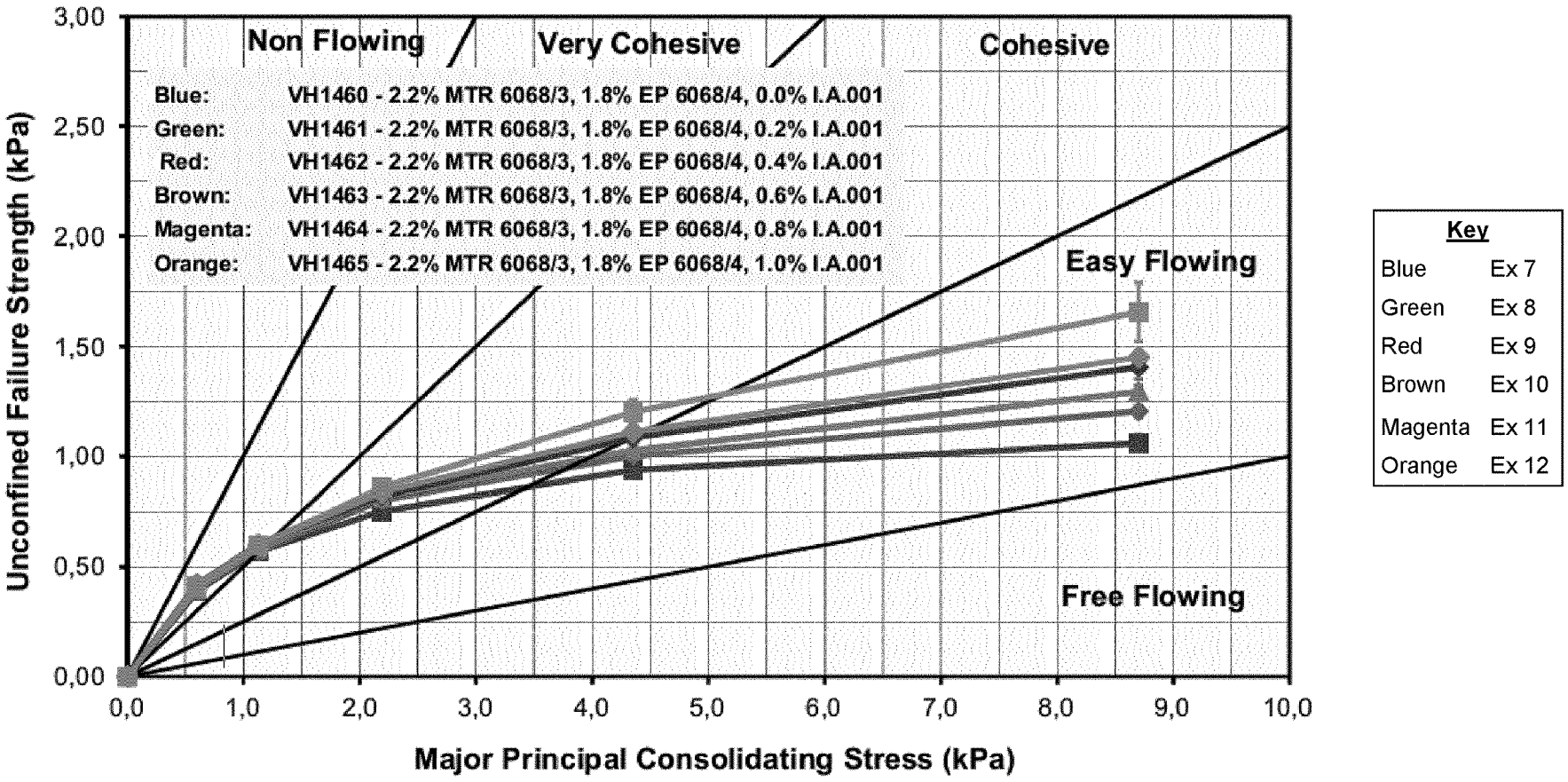
FIG. 3 is a graph of the flowability characteristics of the compositions of Table 2.
Figure 4:
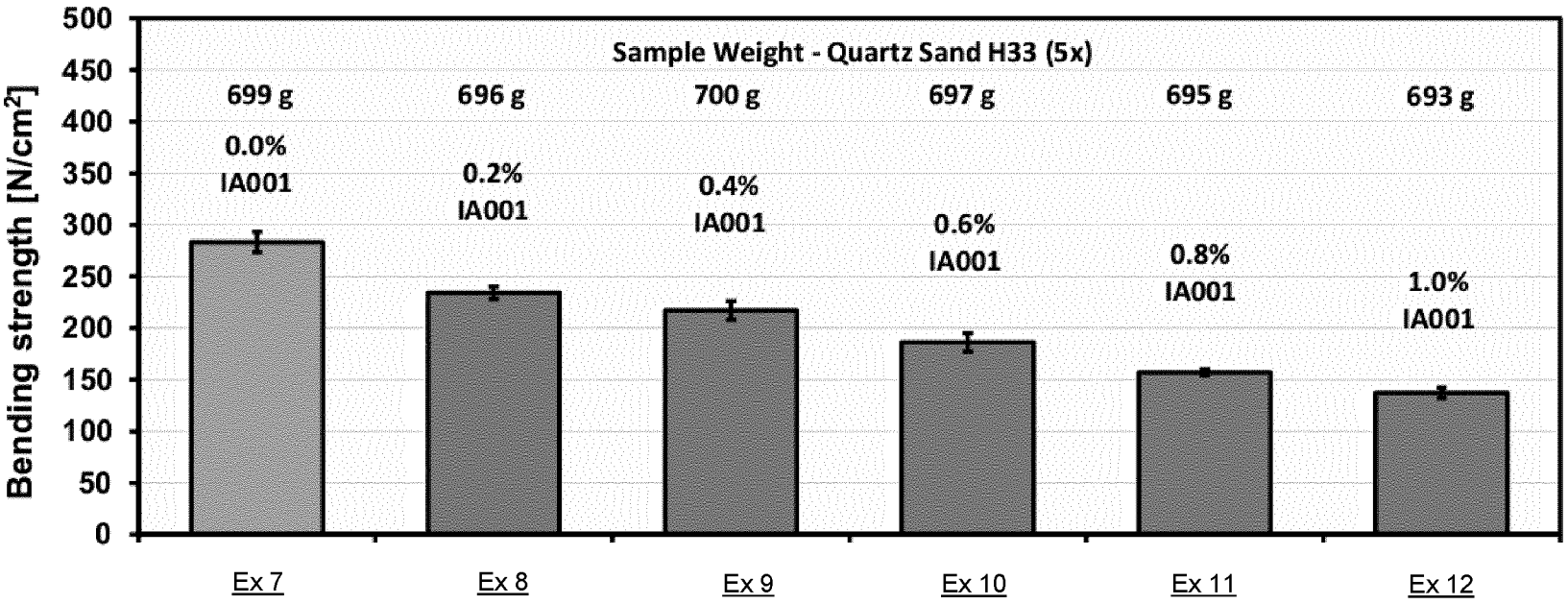
FIG. 4 is a graph of the bending strengths of cores formed from the compositions of Table 2.

Flowability measurements were measured as per Experiment 1 above and results graphed as per FIG. 3. All compositions were found to be easy flowing, with lower gilsonite contents having greater flowability. Subsequently cores were produced under the same conditions and bending strength testing carried out as Experiment 1 above, and the results graphed in FIG. 4. Increasing gilsonite concentration demonstrated an approximately linear decrease in bending strength of the cores. Sample weight for all transverse bars was between 693 g and 700 g, which shows that the gilsonite content does not have a significant effect on compaction levels.

Casting trials with ductile iron were performed at 1380° C. Subsequently, the castings were cooled down to room temperature before the core residue was removed. It was found that cores with the presence of a low amount of Gilsonite (breakdown agent) showed improved breakdown properties in comparison with those without Gilsonite, and the breakdown properties increased with an increase in the Gilsonite concentration, as shown in Table 2 below. After removing core residue, it was clear that sand adhesion decreased with higher levels of the Gilsonite, and that observations of the inner casting surface revealed that surface smoothness increased with higher levels of the Gilsonite. The use of concentration levels of Gilsonite of 0.6 wt % or higher resulted in veining formation in the casting; the higher the concentration the higher the sensitivity for veining. After sand blasting, it was clear that the inner surface of the casting and related to cores without Gilsonite showed a white-shiny appearance. This was not the case when Gilsonite was present, irrespective the concentration level.

TABLE 2

| Composition | Ex 7 | Ex 8 | Ex 9 | Ex 10 | Ex 11 | Ex 12 |
|---|---|---|---|---|---|---|
| **Binder** [a, b] | **2.2%** | **2.2%** | **2.2%** | **2.2%** | **2.2%** | **2.2%** |
| M23NL[1] | 77.5 | 77.5 | 77.5 | 77.5 | 77.5 | 77.5 |
| Water | 22.0 | 22.0 | 22.0 | 22.0 | 22.0 | 22.0 |
| DSK40 [2] | 0.5 | 0.5 | 0.5 | 0.5 | 0.5 | 0.5 |
| **Additives** [a, c] | **1.8%** | **1.8%** | **1.8%** | **1.8%** | **1.8%** | **1.8%** |
| EFA-Füller [10] | 74 | 74 | 74 | 74 | 74 | 74 |
| Silica Fume A [9] | 22 | 22 | 22 | 22 | 22 | 22 |
| Graphite FP70/75 [4] | 4 | 4 | 4 | 4 | 4 | 4 |

TABLE 2-continued

| Composition | Ex 7 | Ex 8 | Ex 9 | Ex 10 | Ex 11 | Ex 12 |
|---|---|---|---|---|---|---|
| **Gilsonite** [a, 11] | **0.0%** | **0.2%** | **0.4%** | **0.6%** | **0.8%** | **1.0%** |
| **Collapsibility** | Moderate | Easy | Easy | Very easy | Very easy | Very easy |

[a] values in bold are in wt % relative to weight of particulate;
[b] values for individual compounds listed below are in wt % relative to weight of total binder;
[c] values for individual compounds listed below are in wt % relative to weight of total additive
[1] Sodium silicate M23NL (BASF, Monheim, Germany)
[2] DSK 40 (2-ethylhexyl sulphate sodium), 0.5% (Anionic surfactant, Brenntag, Enschede, the Netherlands)
[4] Graphite FP70/75 (IMCD Benelux BV, Rotterdam, Netherlands)
[9] Silica Fume A (COFERMIN Chemicals GmbH & Co., Essen, Germany)
[10] EFA Fuller HP, fly ash (Krahn Chemie, Zaandam, Netherlands)
[11] Natural carbon-containing resin, American Gilsonite Company, Utah, USA The present inventors have found that strong lustrous carbon formers (LCFs) are particularly desirable for use in ferrous casting. The high temperatures are believed to require a higher lustrous carbon content in the overall composition in order to achieve the desired improvements in surface quality and in reducing casting defects. By using a strong LCF, this improvement is achieved without significantly affecting the flowability of the composition or the strength of the cores formed therefrom. Without wishing to be bound by theory, although a higher content of weak LCF may provide an equivalent lustrous carbon content and thus in theory provide a similar improvement in casting quality, the reduction in flowability and core strength lead to reductions in casting quality which negate any theoretical improvements. It is believed that the overall lustrous carbon content in the composition can be carefully selected by using a blend of LCFs, including optionally a blend of strong and weak LCFs, in order to achieve the optimal casting conditions without affecting workability or core strength.

Experiment 3—Compositions for Non-Ferrous Casting

Tests were carried out to investigate the suitability of lustrous carbon formers for use in non-ferrous casting processes. A series of cores was prepared using sand and the compounds in Table 3 below.

TABLE 3

| Composition | Ex 13 | Ex 14 | Ex 15 | Ex 16 |
|---|---|---|---|---|
| Binder [a, b] | **2.0%** | **2.0%** | **2.0%** | **2.0%** |
| M23NL[1] | 77.5 | 77.5 | 77.5 | 77.5 |
| Water | 22.0 | 22.0 | 22.0 | 22.0 |
| DSK40 [2] | 0.5 | 0.5 | 0.5 | 0.5 |
| Additives [a, c] | **1.0%** | **1.0%** | **1.0%** | **1.0%** |
| EFA-Fuller [10] | 74 | 74 | 74 | 74 |
| Silica Fume A [9] | 22 | 22 | 22 | 22 |
| Graphite FP70/75 [4] | 4 | 4 | 4 | 4 |
| Tri-calcium phosphate [a] | — | **0.3%** | **0.3%** | **0.3%** |
| Gilsonite [a, 11] | — | — | **0.05%** | **0.10%** |

Figure 5:
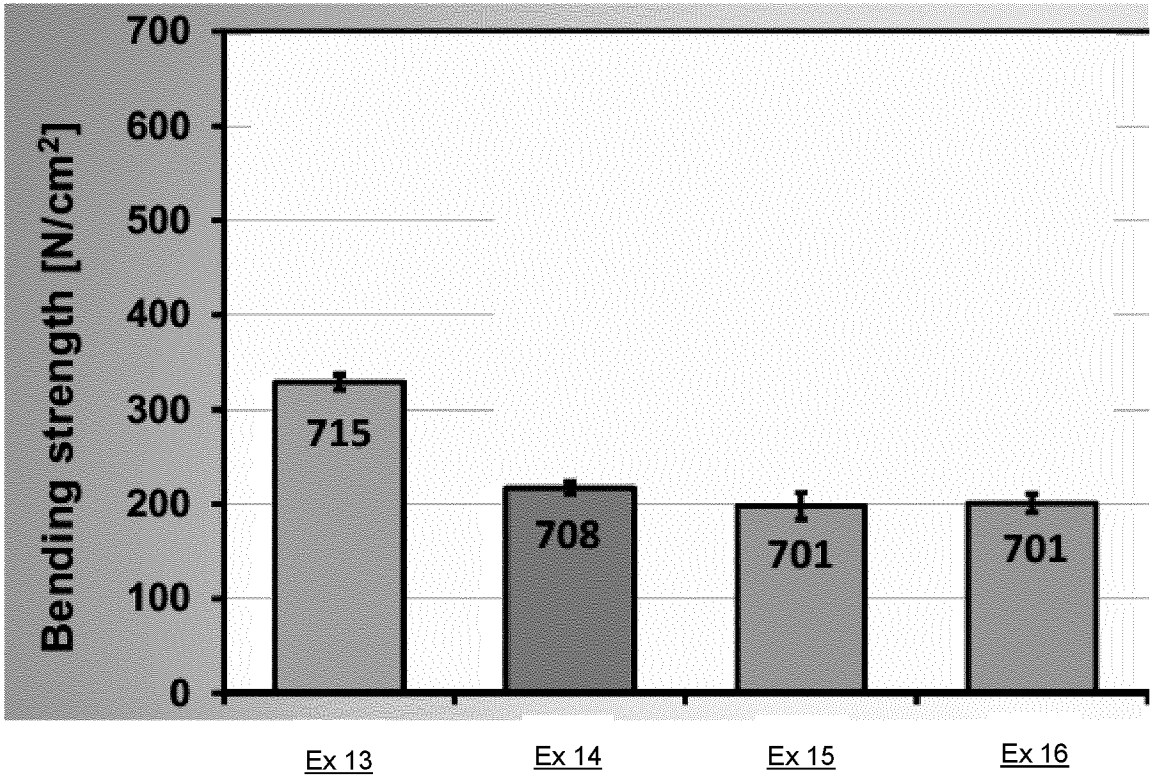
FIG. 5 is a graph of the bending strengths of cores formed from the compositions of Table 3.

[a] values in bold are in wt % relative to weight of particulate;
[b] values for individual compounds listed below are in wt % relative to weight of total binder;
[c] values for individual compounds listed below are in wt % relative to weight of total additive
[1] Sodium silicate M23NL (BASF, Monheim, Germany)
[2] DSK 40 (2-ethylhexyl sulphate sodium), 0.5% (Anionic surfactant, Brenntag, Enschede, the Netherlands)
[4] Graphite FP70/75 (IMCD Benelux BV, Rotterdam, Netherlands)
[9] Silica Fume A (COFERMIN Chemicals GmbH & Co., Essen, Germany)
[10] EFA Fuller HP, fly ash (Krahn Chemie, Zaandam, Netherlands)
[11] Natural carbon-containing resin, American Gilsonite Company, Utah, USA The flowability was tested as in Experiment 1. All compositions had very similar profiles and showed no obvious differences in flowability, and were easy flowing. A series of transverse bars were formed using the compositions, solidified and the strengths tested as per Experiment 1. The results were graphed and are found in FIG. 5. The presence of a small amount of tri-calcium phosphate lead to a significant decrease in bending strength, and low concentrations of Gilsonite were not found to have a significant effect on strength values.

Cores formed from the compositions in Table 3 were tested in a casting trial using aluminium with a pouring temperature of 745° C. Higher magnifications showed, in case of Ex. 15 and 16 which included a small amount of Gilsonite, small gas defects at the inner surface of the aluminium castings. However, severe deformation occurred of the aluminium casting material in Ex 15 and Ex 16, with the higher concentration of Gilsonite showing greater deformation. The use of Gilsonite for aluminium casting was not considered workable.

TABLE 4

| Composition | Ex 17 | Ex 18 | Ex 19 | Ex 20 |
|---|---|---|---|---|
| Binder [a, b] | **2.4%** | **2.1%** | **2.1%** | **2.2%** |
| Crystal 0230 [12] | — | 90 | 90 | 90 |
| ZSE874 [13] | 90 | — | — | — |
| Water | 5 | 4.5 | 4.5 | 4.5 |
| Kasil 1841 [14] | 4.5 | 5 | 5 | 5 |
| DSK40 [2] | 0.5 | 0.5 | 0.5 | 0.5 |
| Additives [a, c] | **1.2%** | **1.0%** | **1.0%** | **1.2%** |
| Silica Fume A [9] | 62 | 78 | 78 | 78 |
| Aluminium metaphosphate | 20 | — | — | — |
| AFS200 [15] | 6 | 8 | 8 | 8 |
| AF96/97 [16] | — | 7 | 7 | 14 |
| Graphite FP70/75 [4] | 12 | — | — | — |
| GC-190 [17] | — | 7 | — | — |
| GC-145 [18] | — | — | 7 | — |
| Fused silica [a] | — | **0.2%** | **0.2%** | **0.2%** |
| Aluminium metaphosphate [a] | — | — | — | **0.1%** |

[a] values in bold are in wt % relative to weight of particulate;
[b] values for individual compounds listed below are in wt % relative to weight of total binder;
[c] values for individual compounds listed below are in wt % relative to weight of total additive
[2] DSK 40 (2-ethylhexyl sulphate sodium), 0.5% (Anionic surfactant, Brenntag, Enschede, the Netherlands)
[4] Graphite FP70/75 (IMCD Benelux BV, Rotterdam, Netherlands)
[9] Silica Fume A (COFERMIN Chemicals GmbH & Co., Essen, Germany)
[12] Sodium silicate solution Crystal 0230 (PQ Corporation, Eijsden, the Netherlands)
[13] Sodium silicate solution ZSE874 (PQ Corporation, Eijsden, the Netherlands)
[14] Kasil 1841 (PQ Corporation, Eijsden, the Netherlands)
[15] Cerabeads AFS 200 (Ziegler & Co. Wunsiedel, Germany)
[17] Graded coal GC-190 (James Durrance Sons Ltd, UK)
[18] Graded coal GC-145 (James Durrance Sons Ltd, UK)

A series of cores for use with a permanent die for aluminium casting were prepared according to Table 4 below. The cores were tested in a casting trial using aluminium with a pouring temperature of approximately 730° ° C. After solidification in the permanent die, the castings were stored for 30 minutes in a pre-heated furnace at 500° C. After solidification, core Ex. 17 (without a lustrous carbon former: graded coal) showed more sand adhesion. The use of graded coal-145 lead to a higher surface quality compared to graded coal-190.

Without wishing to be bound by theory, it is believed that lustrous carbon formers such as Gilsonite are too strong to be effective for use in non-ferrous and/or lower temperature castings.

Experiment 4—Lustrous Carbon Former Investigations

Figure 6:
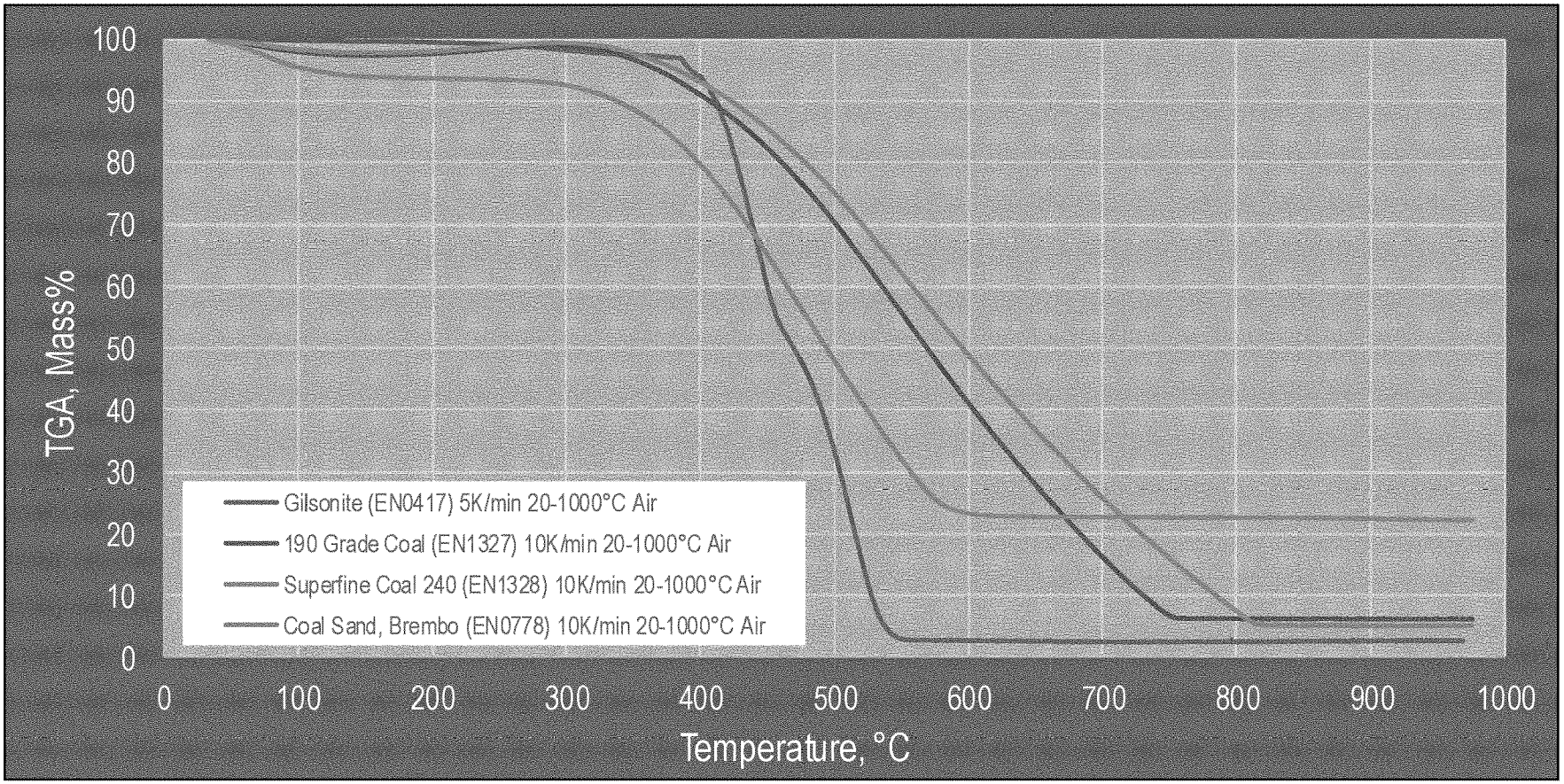
FIG. 6 is a graph showing the Thermogravimetric Analysis of four lustrous carbon formers.

Thermogravimetric analysis was carried out for four lustrous carbon formers: Gilsonite, Graded Coal-190, Superfine Graded Coal-240, and Coal Sand. The analysis was carried out from 20-1000° C. at a rate of 10° C./min, with the exception of Gilsonite, which was tested at a rate of 5° C./min. As is shown in FIG. 6, although all four lustrous carbon formers began to lose mass from approximately 400° C., the Gilsonite sample lost mass far more rapidly than the other three lustrous carbon formers.

Table 5 shows a list of lustrous carbon formers and typical lustrous carbon content contained therein.

TABLE 5

| Lustrous carbon former | Lustrous carbon content |
|---|---|
| Polystyrene | 56% |
| Hydrocarbon resin | 38-48% |
| Gilsonite | 35% |
| Asphalt | 26-32% |
| Coal dust | 8-14% |
| Graded coal | 8-12% |
| Seacoal | 10% |

Without wishing to be bound by theory, the inventors believe that the rate at which the lustrous carbon formers are able to volatilise under the casting conditions significantly affects the activity of the lustrous carbon former (LCF) to reduce surface defects in the casting. For lower temperatures, such as in aluminium and other non-ferrous casting processes, weak lustrous carbon formers have surprisingly been found to be more effective. For higher temperatures such as found in ferrous casting processes, the use of strong lustrous carbon formers has been found to be surprisingly effective. As used herein, the terms strong and weak reflect both the LCFs volatility and the overall content of lustrous carbon within the additive. Experiments carried out with alternative carbon sources, such as graphite, were found to be far less effective than LCFs. The most effective LCF for any particular casting process is a balance between strength of the LCF effect, pouring temperature of the casting and the requirement to minimise strength loss of the core through LCF addition rates.

Experiment 6 Foundry Moulding Compositions and Core Production

Various cores were produced under the following conditions: sand, liquid binder and additives as specified in Table 6a below were mixed with a commercially available batch mixer (Hobart) with a batch size of 20 litre, whereby the additive and liquid binder were added in parallel with a mixing time of 2×1 min.

TABLE 6A

| Composition | Ex 21 | Ex 22 | Ex 23 |
|---|---|---|---|
| Particulate refractory material | Silica sand QQS 26 [22] | Silica sand F32 [23] | Silica sand HB32 [24] |
| Binder [a, b] | **2.1%** | **1.6%** | **1.8%** |
| Crystal 0230 [12] | 79.5 | — | 84.5 |
| ZSE874 [13] | — | 79.5 | — |
| Water | 20 | 20 | 5 |
| Kasil 1841 [14] | 5 | 5 | 5 |
| Silres BS16 [19] | — | — | 5 |
| DSK 40 [2] | 0.5 | 0.5 | 0.5 |
| Total additives [a, c] | **1.2%** | **0.6%** | **0.6%** |
| Fused Silica 325 [20] | 16.7 | — | — |
| Silica Fume A [9] | 65 | 60 | 26 |
| AFS 200 [15] | 6.6 | — | — |
| GC-190 [17] | 11.7 | — | — |

TABLE 6A-continued

| Composition | Ex 21 | Ex 22 | Ex 23 |
|---|---|---|---|
| Eurocell 150H [21] | — | 6 | 6 |
| Gilsonite [11] | — | 34 | 68 |

[a] values in bold are in wt % relative to weight of particulate;
[b] values for individual compounds listed below are in wt % relative to weight of total binder;
[c] values for individual compounds listed below are in wt % relative to weight of total additive
[2] DSK 40 (2-ethylhexyl sulphate sodium), 0.5% (Anionic surfactant, Brenntag, Enschede, the Netherlands)
[11] Natural carbon-containing resin, American Gilsonite Company, Utah, USA
[12] Sodium silicate solution Crystal 0230 (PQ Corporation, Eijsden, the Netherlands)
[13] Sodium silicate solution ZSE874 (PQ Corporation, Eijsden, the Netherlands)
[14] Kasil 1841 (PQ Corporation, Eijsden, the Netherlands)
[15] Cerabeads AFS 200 (Ziegler & Co. Wunsiedel, Germany)
[17] Graded coal GC-190 (James Durrance Sons Ltd, UK)
[19] silicon organic water repellent (Wacker Chemie AG, Stuttgart, Germany)
[20] Fused Silica 325 (Imerys Fused Minerals Greeneville Inc., Greeneville, USA)
[21] Pozzolanic filler - aluminium-silicate (Stauss-Perlite GmbH, Poelten, Austria)
[22] QQS 26 (D50 particle size 0.26 mm) (Wolff und Muller Quarzsande GmbH, Germany);
[23] F32 (D50 particle size 0.24 mm) (Quarzwerke GmbH, Frechen, Germany);
[24] HB32 (D50 particle size 0.30 mm) (Quarzwerke GmbH, Frechen, Germany);

The mixtures were introduced into core shooters as set out in Table 6b below and cores were produced under the conditions therein.

Ex 21—After storing the cores 24 hours at an air temperature of 20° C. at a relative humidity of 40% a strength test was performed. The cores had a cold strength of about 400 N/cm$^2$ as measured according to Experiment 1 above. Casting trials were carried out with the alloy $AlSi_7Cu_4Mg_{0.5}$. Pouring temperature was 760° C. and the total amount of aluminium was for each casting trial 39 kg. The inner surface of the casting specimen showed a clean surface without sand adhesion. No coating was applied to the cores.

TABLE 6B

| | Ex 21 | Ex 22 | Ex 23 |
|---|---|---|---|
| Core shooter | DISA CORE 20L | Laempe L1 | DISA CORE 20L |
| Core box temp. | 140° C. | 140° C. | 140° C. |
| Shooting pressure | 4 bar | 4 bar | 4 bar |
| Shooting time | 2 × 1 s | 1 × 1 s | 2 × 1 s |
| Purging air temperature | 165° C. | 120° C. | 165° C. |
| Purging time | 50 s | 60 s | 50 s |
| Non-pressurised time | 5 s | 5 s | 5 s |
| Curing air pressure | 3.0 bar (300 kPa) | 4.0 bar (400 kPa) | 3.0 bar (300 kPa) |

Ex 22—After storing the cores 1 hour at an air temperature of 20° C. at a relative humidity of 50% a strength test was performed. The cores had a hot cold strength of 350 N/cm$^2$ as measured as per Experiment 1. No coating was applied to the cores. Casting trials were carried out with the alloy CC491. Pouring temperature was 1150° C. and the total amount of the alloy was for each casting trial 20 kg. The inner surface of the casting specimen showed a clean surface without sand adhesion.

Ex 23—After storing the cores 24 hours at an air temperature of 20° C. at a relative humidity of 50% a strength test was performed. The cores had a strength of 500 N/cm$^2$ measured as per Experiment 1 No coating was applied to the cores. Casting trials were carried out with nodular cast iron GJS600. Pouring temperature was 1450° C. and the total amount of the alloy was for each casting trial 160 kg. Smooth and sand-free surfaces of differential housings as test specimen were achieved with the cores produced as above described.

The invention claimed is:

1. A composition for making a core for use in a metal casting process, the composition comprising:

a particulate refractory material;

0.5 wt % to 5 wt % of an inorganic binder comprising one or more of sodium silicate, potassium silicate, lithium silicate, or a combination thereof;

0.1 wt % to 2 wt % of a pozzolanic additive, comprising one or more of silica fume, fused silica, pyrogenic silica, and micro-silica; and 0.1 to 1.5 wt % of a lustrous carbon former, wherein said weight percentages are relative to the weight of the particulate refractory material.

2. The composition according to claim 1, for making a core for use in a ferrous metal casting process, and wherein the lustrous carbon former is a strong lustrous carbon former, wherein the strong lustrous carbon former has a lustrous carbon content of at least 15%.

3. The composition according to claim 2, wherein the strong lustrous carbon former comprises one or more of: asphalt; hydrocarbon resin; polystyrene; and gilsonite.

4. The composition according to claim 1, for making a core for use in a non-ferrous metal casting process, and wherein the lustrous carbon former is a weak lustrous carbon former, wherein the weak lustrous carbon former has a lustrous carbon content of less than 15%.

5. The composition according to claim 4, wherein the weak lustrous carbon former comprises one or more of: graded coal, coal dust, and seacoal.

6. The composition according to claim 1, wherein the particulate refractory material comprises sand.

7. A core formed from the composition of claim 1.

8. A process for producing a metal article by metal casting, the process comprising:

(i) mixing a composition according to claim 1 to form a mixture;

(ii) moulding and hardening the mixture to produce a core in the shape of an internal cavity of the article;

(iii) assembling the core with a mould for metal casting, such that the mould and the core together define a casting cavity;

(iv) supplying molten metal into the mould cavity until the mould cavity is filled;

(v) cooling and solidifying the molten metal to form the article.

9. The process of claim 8, for producing a ferrous metal article by ferrous metal casting, wherein;

step (iv) is carried out at a temperature of at least 1000° C.

10. The process of claim 8, for producing a non-ferrous metal article by non-ferrous metal casting, wherein;

step (iv) is carried out at a temperature of less than 1200° C.

* * * * *